United States Patent [19]

Brown, III

[11] Patent Number: 4,894,034

[45] Date of Patent: Jan. 16, 1990

[54] BODYBOARD WITH INTEGRALLY-CONTOURED HAND-HOLDS FOR ENHANCING CONTROL DURING RIDING

[75] Inventor: Russell S. Brown, III, Honolulu, Hi.

[73] Assignee: Kransco, San Francisco, Calif.

[21] Appl. No.: 104,339

[22] Filed: Oct. 2, 1987

[51] Int. Cl.[4] ..... A63C 15/00

[52] U.S. Cl. ..... 441/65; 441/74; 280/18.1

[58] Field of Search ..... 441/65, 66, 67, 74, 441/79, 129; 272/1 B; D21/236, 237; 280/18, 18.1

[56] References Cited

U.S. PATENT DOCUMENTS

| | | | |
|---|---|---|---|
| D. 244,315 | 5/1977 | Havstad | D21/236 |
| D. 246,066 | 10/1977 | O'Farrell | D21/237 |
| 3,384,910 | 5/1968 | Heston et al. | 441/65 |
| 3,722,015 | 3/1973 | Miller et al. | 441/65 |
| 4,362,518 | 12/1982 | Boissiere | 272/1 B |
| 4,406,628 | 9/1983 | Rademacher | 441/129 |
| 4,752,260 | 6/1988 | Stewart | 441/65 |

*Primary Examiner*—Joseph F. Peters, Jr.
*Assistant Examiner*—Thomas J. Brahan
*Attorney, Agent, or Firm*—Kolisch, Hartwell & Dickinson

[57] ABSTRACT

A bodyboard configured for enhanced control includes hand-holds disposed adjacent each side edge configured for being securely gripped by a rider and for orienting and maintaining a rider's hand in a predetermined position relative to the length of the bodyboard. The present invention is directed further to a bodyboard having a "scoop" provided on the front nose end, which is defined by a concave section which provides an enhanced gripping surface for a rider's extended or leading arm. Thus, the leading and trailing arms both have secure hand-holds so that controlled turns and other maneuvers may be effected by a rider.

7 Claims, 1 Drawing Sheet

BODYBOARD WITH INTEGRALLY-CONTOURED HAND-HOLDS FOR ENHANCING CONTROL DURING RIDING

BACKGROUND AND SUMMARY OF THE INVENTION

The present invention relates to sporting goods and recreational products, and more particularly to an improved bodyboard for use in riding ocean surf. Bodyboards are surfing devices somewhat akin to surfboards, with the major differences being that bodyboards are shorter in length, lighter in construction and used to support a rider in a supine position for riding waves. Bodyboards are shaped from a foam plank which is then covered with a top riding surface of plastic material and a bottom surface of slick material for enhancing planing effect during riding.

The most popular mode of riding a bodyboard is for an individual to recline stomach-down against the riding surface, with the front arm extending forwardly for gripping the nose of the bodyboard and the opposite arm positioned in a trailing manner for gripping the side edge of the device. With one arm extended forwardly, and the other to the rear, a bodyboard rider may lift or push down with either or both arms, as the case requires, to effect turning and cutting action during riding. A rider may raise his/her body up somewhat by bending the forward arm for propping up on the elbow. Bodyboarding is a very fast-paced and exhilarating sport, and has evolved into competitions where tricks and maneuvers requiring a high degree of coordination and aggressiveness are attempted. Tricks such as the "el rollo," "drop me off," "belly 360," and others are ones which involve daring and precise maneuvers mandating that a rider have complete control over the board.

To maintain complete control, a rider must grip the board securely, but this can become a problem because water covers the board's surfaces. Conventional boards are provided with nose ends which are straight or blunt, as opposed to the single, peaked ends typically found on surfboards. Blunt nose ends are used on conventional bodyboards because a rider must grip that end without slipping off. However, a rider's hand easily can slip off, resulting in an aborted or out-of-control ride. The hand of the trailing arm may also inadvertently slip from gripping a side edge. In any case, for a rider to perform either long, drawn out turns, or short, "snappy" turns, or the wide variety of tricks in competitions, a sure grip is necessary.

The present invention seeks to overcome problems of hand slippage in conventional boards, and to that end, contemplates a bodyboard provided with hand-hold means disposed adjacent each side edge configured for being securely gripped by one of the rider's hands for orienting and maintaining that hand in a predetermined position relative to the length of the bodyboard.

More specifically, it is an object of the present invention to provide a bodyboard having a pair of offset means or sections provided adjacent each side edge. The offset sections are elongate, substantially planar surfaces which divide each side edge into fore and aft sections Each offset section is dimensioned with an overall length sufficient for accommodating a rider's palm, with the thumb being positioned on top of the bodyboard, adjacent the offset section, and the remaining fingers curled around for gripping the bottom of the board. Each offset section is dimensioned with a length generally in the range of 2 to 5 inches, thereby presenting an area to block or inhibit forward movement of the hand, by engaging the palm, so that the rider may grip the side edge with security.

Another object of the present invention is to provide a contoured nose end which serves as an abutment means to inhibit slippage of the rider's forwardly-extended hand. The abutment means is defined, in a preferred embodiment, as a concave nose section for receiving the hand but which will limit that hand from slippage toward either side.

Still another object of the present invention is to provide a ridge means, adjacent each offset section, which will stabilize or at least prevent substantial lateral shifting of the rider's thumb.

These and additional objects and advantages of the present invention will be more readily understood from the brief description of the drawings and the following detailed description of the preferred embodiment.

DETAILED DESCRIPTION OF THE PREFERRED EMBODIMENT

As mentioned at the outset, it is a principal object of the present invention to provide an improved bodyboard which is configured with means for enabling secure gripping by a bodyboarder during riding in ocean surf. To that end, the bodyboard of the present invention is provided with sections contoured specifically for enhancing hand grip and thereby control of the board during riding.

Figure 1:
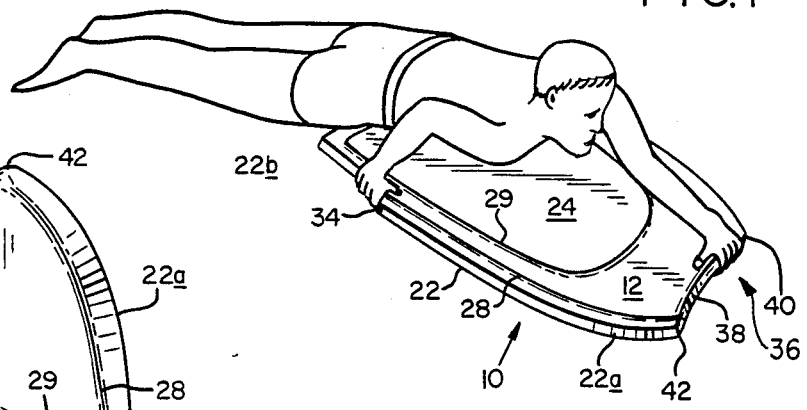
FIG. 1 is a perspective view of a bodyboard rider positioned on a bodyboard according to the present invention in a typical riding mode or position.

FIG. 1 of the drawings shows a bodyboarder riding a bodyboard 10 according to the present invention. The rider is depicted in typical riding position, with one arm extended forwardly for gripping the nose end of bodyboard 10, while the other arm is disposed in a trailing manner for engaging a rear portion of the bodyboard along its side edge. The rider is shown at least partially propped-up on his left elbow.

Figure 2:
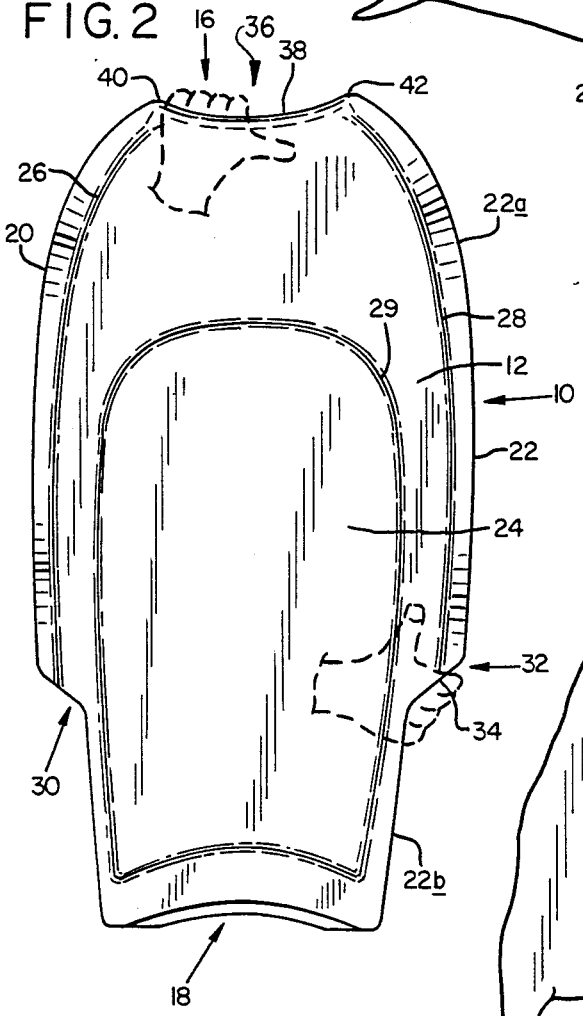
FIG. 2 is a top plan view of the bodyboard of the present invention showing, in dashed lines, positioning of the leading and trailing hands during riding.

As shown in FIG. 2, bodyboard 10 is an elongate, substantially planar board formed from a foam plank having a riding surface 12, a bottom planing surface 14 (see FIG. 4), a front nose end 16, a tail section generally indicated at 18, and elongate, laterally opposed side rails or edges 20, 22. Each side edge includes a fore side edge portion and an aft side edge portion, as exemplified by portions 22*a*, 22*b*, respectively, of side edge 22. The top and bottom surfaces of the bodyboard are covered with suitable synthetic material, and as shown in FIG. 2, a foam pad which is hidden beneath the top surface of the bodyboard is indicated at 24. It will also be observed that elongate ridge means, such as indicated at 26, 28 are positioned approximately 1½ inches inwardly from each fore side edge portion, extending substantially over its length.

Figure 3:
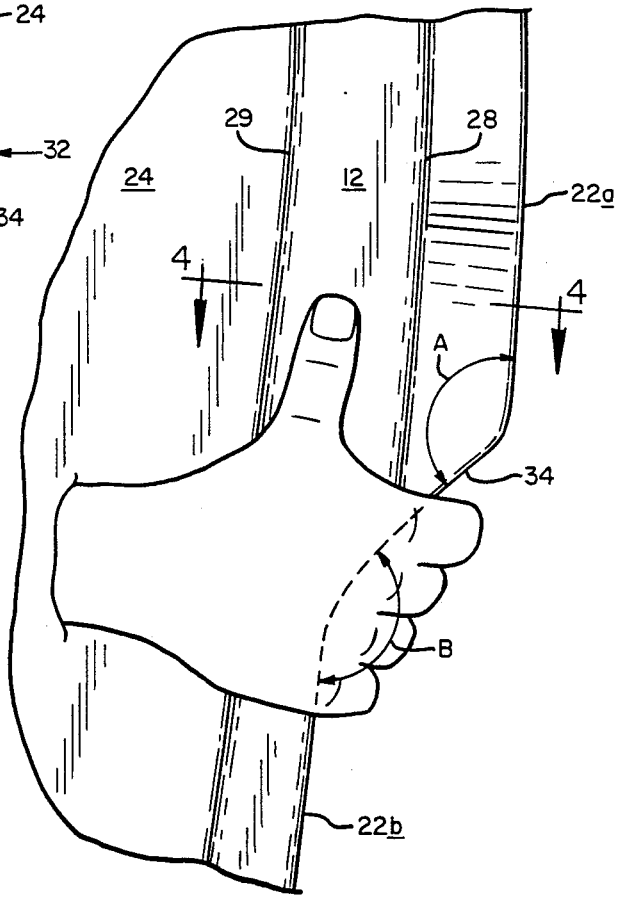
FIG. 3 is an enlarged view of the offset portion of the bodyboard for enabling gripping by the trailing hand.

A principal feature of the present invention is the inclusion of hand-hold means indicated generally at 30, 32 associated with each of the side edges. The hand-hold means are integrally-contoured in the board and are configured for being securely gripped by the rider's trailing hand, and for orienting and maintaining that hand in a predetermined, secure position relative to the length of an associated edge. Each hand-hold means is dimensionally formed substantially as a mirror-image of the other, and therefore only hand-hold means 32 will be discussed in detail. As shown in FIGS. 2 and 3, it can be seen that hand-hold means 32 is defined by an, offset section (edge section) 34, joining the rear end of fore side edge portion 22*a* and the forward end of aft side edge portion 22*b*.

Figure 4:
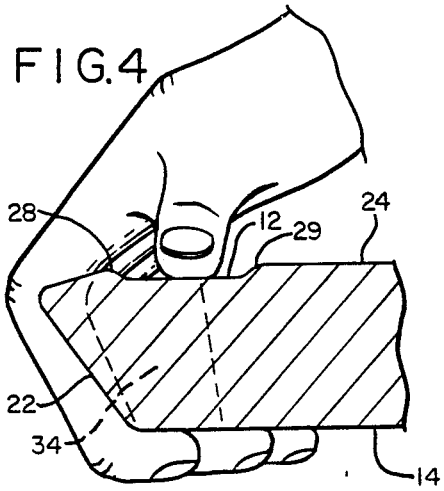
FIG. 4 is a view taken along lines 4—4 of FIG. 3.

Offset section 34 is directed at an angle relative to the board's longitudinal axis, and is dimensioned with an overall length and depth defining a surface area sufficient for accommodating reception of a substantial portion of rider's palm. For example, as shown in FIGS. 3 and 4, offset section 34 is shown being gripped by the hand of a rider, so that the fingers curl around the offset section and engage bottom planing surface 14. The rider's thumb is shown positioned on top surface 12, and is disposed between ridge means 28, 29. As shown in FIG. 3, the rider's hand is positioned slightly rearwardly, so that the entire length of offset section 34 does not necessarily fit within the palm. As shown, the rider's hand is positioned so that a portion of it engages aft side edge portion 22*b* of the side edge. In any case, FIG. 3 shows one position of the hand, but it is contemplated that the hand may be selectively shifted by an individual for purposes of comfort and riding action. The point is that the length of offset section 34 is dimensioned in the range of 2 to 5 inches so that a surface area is presented for palm engagement. The depth of offset section is in the range of 1 to 3 inches, with about 2 inches being preferable.

It will also be noted that offset section 34 is defined by a substantially linear stretch which is disposed at an angle, directed inwardly toward the longitudinal axis of the bodyboard, relative to the side edges. In particular, offset section 34 is oriented at an angle generally in the range of 90 to 160 degrees relative to the adjacent portion of the fore side edge portion of associated side edge 22. As specifically illustrated, angle A is oriented at approximately 133 degrees. Similarly, angle B is 133 degrees, although other angles could be provided within the relative range of 90 to 160 degrees. The important point to note is that the combination of the length of the offset section and its angular positioning provides a secure hand-hold substantially preventing inadvertent slippage. This means that the rider may lift or push down, or even push forward, as the case may be, without the hand slipping.

Another feature of the present invention, as mentioned briefly above, is the provision of the ridge means, such as indicated at 28 in FIGS. 2, 3 and 4. The ridge means are disposed adjacent each offset section for inhibiting lateral movement of the thumb when the offset section is gripped. As shown in FIG. 4, ridge means 28 will prevent the thumb from slipping toward the outside and off the side edge. While an auxiliary ridge means, such as indicated at 29, may be provided, it is obvious that the thumb can rotate inwardly only a certain amount, whereas a much greater degree of rotation occurs toward the outside, thus making ridge means important for localizing and securing position of the rider's trailing arm and hand.

Another significant feature of the present invention is provided at front nose end 16 of bodyboard 10. Specifically, a restraining means is disposed adjacent the bodyboard's nose end for inhibiting slippage from that end when gripped by the hand on the rider's extended or leading arm. The restraining means, generally indicated at 36, is defined by a concave surface 38 serving as an abutment means defined by the concave expanse which meets with the associated side rails 20, 22. Where concave surface 38 meets the side rails, such as at points or nodes 40, 42, respectively, an abutment is provided which substantially inhibits the hand from slipping, as shown in FIG. 2, over node 40. Prior-art bodyboards, as mentioned above, have a nose end which is straight or blunt, meaning that when it is gripped, it is easy for the hand to slip off to one side. By providing the abutment means defined by a recess preferably taking the form of a concave expanse, such as indicated at 38, a rider may grip the nose end of the bodyboard in a secure manner.

The features described with reference to the foregoing improved bodyboard provide substantial advantages in riding, whether tricks are being performed or more routine maneuvers. Hand-hold means 30, 32, defined by offset sections dimensioned for accommodating a rider's hand, provide sure gripping sections which "lock-in" the hand to enhance maneuverability and control. The ridge means and the front nose end restraining means, defined by concave surface 38 also increase purchase, with the overall effect being controlled, precise riding action, whether performing sharply angled or more gradual turns, or performing complex maneuvers such as the "el rollo," etc.

While the present invention has been shown and described with reference to the foregoing preferred embodiment, it will apparent to those skilled in the art that other changes in form and detail may be made without departing from the scope and spirit of the invention as defined in the appended claims.

It is claimed and desired to secure by letters patent:

1. A bodyboard for supporting a rider during travel in ocean surf comprising:

an elongate, substantially planar board of substantially equal thickness having a top riding surface, a bottom planing surface, a forward section extending a major portion of the length of the board terminating in a front nose end for the board, a tail section extending a minor portion of the length of the board terminating in a rear end for the board, opposed fore side edge portions bounding opposite sides of said forward section and opposed aft side edge portions bounding opposed sides of said tail section, said fore side edge portions having rear ends adjacent the forward ends of said aft side edge portions and rear ends of the fore side edge portions being spaced laterally a greater distance than the forward ends of the aft side edge portions and the aft side edge portions extending nondivergently to the rear end of the board; and hand-hold means disposed on each side of the board contoured for being securely gripped by a hand of the rider and for orienting and maintaining that hand in a predetermined position relative to the length of the board, wherein each hand hold means is defined by an offset edge section extending from the rear end of a fore side edge portion to the forward end of an aft side edge portion and oriented at an angle generally in the range of 90 to 160 degrees relative to the rear end of the fore side edge portion and dimensioned with an overall length sufficient for accommodating a rider's palm thereby to inhibit forward slippage of the rider's hand when the board is gripped at the offset edge section.

2. The bodyboard of claim 1 wherein the offset edge section is dimensioned with a length generally in the range of 'to 5 inches.

3. The bodyboard of claim 1 wherein ridge means are disposed adjacent each offset edge section for inhibiting lateral movement of the rider's thumb when the offset edge section is gripped.

4. A bodyboard for supporting a rider during travel in ocean surf comprising:

an elongate, substantially planar board of substantially equal thickness having a top riding surface, a bottom planing surface, a front nose end, a tail section, and elongate, laterally-opposed side edges; and restraining means disposed adjacent the front nose end, defined by opposed abutment points separated by an expanse extending intermediate the side edges adjacent the front nose end, wherein said abutment points are created by a discontinuity between the expanse and the forwardmost point of the corresponding side edge, thereby inhibiting slippage of the rider's hand off to one side from the nose end.

5. The bodyboard of claim 4 wherein the expanse is contoured as a concave surface which faces the direction of travel.

6. A bodyboard for supporting a rider during travel in ocean surf comprising:

an elongate, substantially planar board of substantially equal thickness having a top riding surface, a bottom planing surface, a forward section extending a major section portion of the length of the board terminating in a front nose end for the board, a tail section extending a minor portion of the length of the board terminating in a rear end for the board, opposed fore side edge portions bounding opposite sides of said forward section and opposed aft side edge portions bounding opposed sides of said tail section, said fore side edge portions having rear ends adjacent forward ends of the aft side edge portions and the rear ends of the fore side edge portions being spaced laterally a greater distance than the forward ends of the aft side edge portions and the aft side edge portions extending nondivergently to the rear end of the board; and hand-hold means disposed on each side of the board contoured for being securely gripped by a hand of the rider and for orienting and maintaining that hand in a predetermined position relative to the length of the board, wherein each hand-hold means is defined by an offset edge section extending from the rear end of a fore side edge portion to the forward end of an aft side edge portion and oriented at an angle generally in the range of 90 to 160 degrees relative to the rear end of the fore side edge portion and dimensioned with a length generally in the range of 2 to 5 inches for accommodating a rider's palm thereby to inhibit forward slippage of the rider's hand when the board is gripped at the offset edge section; and restraining means disposed adjacent the front nose end, defined by opposed abutment points separated by an expanse extending intermediate the side edges adjacent the front nose end, wherein said abutment points are created by a discontinuity between the expanse and the forward most point of the corresponding side edge, thereby inhibiting slippage of the rider's hand off to one side from the nose end.

7. A bodyboard for supporting a rider during travel in ocean surf comprising:

an elongate, substantially planar board having a top riding surface, a bottom planing surface, a front nose end, a rear tail section, and elongate, laterally opposed sided edges; and non-obstructed ridge means extending along the top riding surface adjacent each side edge dimensioned for presenting an inwardly facing ridge surface that abruptly inclines with respect to portions of the top surface of the board immediately adjacent the ridge surface against which a rider's thumb may engage when an associated side edge is gripped, thereby inhibiting slippage of the rider's thumb laterally outwardly away from the board.

* * * * *